US010407214B2

(12) United States Patent
Gersovitz

(10) Patent No.: US 10,407,214 B2
(45) Date of Patent: Sep. 10, 2019

(54) MULTI-COMPARTMENT CONTAINERS

(71) Applicant: Gerry Gersovitz, San Francisco, CA (US)

(72) Inventor: Gerry Gersovitz, San Francisco, CA (US)

(73) Assignee: Gerry Gersovitz, San Francisco, CA (US)

( * ) Notice: Subject to any disclaimer, the term of this patent is extended or adjusted under 35 U.S.C. 154(b) by 9 days.

(21) Appl. No.: 15/640,793

(22) Filed: Jul. 3, 2017

(65) Prior Publication Data

US 2017/0297769 A1 Oct. 19, 2017

Related U.S. Application Data

(60) Continuation-in-part of application No. 14/693,765, filed on Apr. 22, 2015, which is a division of (Continued)

(51) Int. Cl.

| | |
|---|---|
| ***B65D 1/04*** | (2006.01) |
| ***B65D 25/04*** | (2006.01) |
| ***B65D 5/48*** | (2006.01) |
| ***B65D 43/14*** | (2006.01) |
| ***B65D 30/22*** | (2006.01) |
| ***B65D 35/22*** | (2006.01) |

(52) U.S. Cl.

CPC ..... *B65D 25/04* (2013.01); *B65D 1/04* (2013.01); *B65D 5/48* (2013.01); *B65D 31/12* (2013.01); *B65D 35/22* (2013.01); *B65D 43/14* (2013.01)

(58) Field of Classification Search

CPC ..... B65D 81/3288; B65D 1/30; B65D 1/04; B65D 47/06; B65D 35/22

See application file for complete search history.

(56) References Cited

U.S. PATENT DOCUMENTS

| | | | |
|---|---|---|---|
| 771,372 | A | 10/1904 | Kruse |
| 861,815 | A | 7/1907 | Cullen |

(Continued)

FOREIGN PATENT DOCUMENTS

| | | |
|---|---|---|
| CA | 2737981 | 10/2014 |
| FR | 2701924 | 9/1994 |
| WO | 2018/006085 A1 | 1/2018 |

OTHER PUBLICATIONS

Non-Final Office Action dated Sep. 23, 2010 for U.S. Appl. No. 12/415,910, 9 pages.

(Continued)

*Primary Examiner* — Shawn M Braden

(74) *Attorney, Agent, or Firm* — Kilpatrick Townsend & Stockton LLP

(57) ABSTRACT

Multi-compartment containers including multi-compartment cans, canisters, boxes and bags and methods for using the same are disclosed. Multi-compartment containers that provide access to one portion of the contents until depleted while maintaining a seal and thus protecting the freshness or potency, of the contents on another portion allows products to be packaged and sold in a way that maintains freshness and potency longer. Each compartment of the multi-compartment containers can be configured to have either a single-use or re-sealable seal.

19 Claims, 10 Drawing Sheets

Related U.S. Application Data application No. 13/093,468, filed on Apr. 25, 2011, now abandoned.

(60) Provisional application No. 61/345,974, filed on May 18, 2010, provisional application No. 62/357,644, filed on Jul. 1, 2016.

(56) References Cited

U.S. PATENT DOCUMENTS

| | | | | |
|---|---|---|---|---|
| 1,634,569 | A | 7/1927 | Albert et al. | |
| 1,798,071 | A | 3/1931 | Deane et al. | |
| 1,814,180 | A | 7/1931 | Nicholls et al. | |
| 1,837,343 | A | 12/1931 | Starke et al. | |
| 1,984,570 | A | 12/1934 | Emmons et al. | |
| 2,073,636 | A | 3/1937 | Holoubek et al. | |
| 2,296,951 | A | 9/1942 | Rosen | |
| 2,371,173 | A | 3/1945 | Hothersall | |
| 2,553,559 | A | 5/1951 | Eckman et al. | |
| 2,605,013 | A | 7/1952 | Rubenstein et al. | |
| 2,611,499 | A | 9/1952 | Mayer | |
| 2,679,281 | A | 5/1954 | Paulucci et al. | |
| 2,833,436 | A | 5/1958 | Ruderian et al. | |
| 2,963,194 | A | 12/1960 | Brennan et al. | |
| 3,106,313 | A | 10/1963 | Kurhan | |
| 3,113,668 | A | 12/1963 | Edward et al. | |
| 3,144,152 | A | 8/1964 | Kopp et al. | |
| 3,199,756 | A | 8/1965 | Davy | |
| 3,272,671 | A | 9/1966 | Gaylord et al. | |
| 3,288,342 | A | 11/1966 | Tinker | |
| 3,317,087 | A | 5/1967 | Landis et al. | |
| 3,465,905 | A | 9/1969 | Schottanes | |
| 3,485,416 | A | 12/1969 | Fohrman | |
| 3,580,481 | A | 5/1971 | Koboldt | |
| 4,044,941 | A | 8/1977 | Knudesen | |
| 4,078,686 | A | 3/1978 | Karesh et al. | |
| D270,135 | S | 8/1983 | Gates | |
| 4,444,324 | A | 4/1984 | Grenell | |
| D280,599 | S | 9/1985 | Green | |
| 4,598,832 | A | 7/1986 | Alonso et al. | |
| 4,664,274 | A | 5/1987 | Franz | |
| 4,890,759 | A | 1/1990 | Scanga et al. | |
| 4,925,055 | A | 5/1990 | Robbins et al. | |
| 4,981,214 | A | 1/1991 | Rojas et al. | |
| 5,076,430 | A | 12/1991 | Philpot et al. | |
| 5,258,191 | A | 11/1993 | Hayes | |
| 5,279,841 | A | 1/1994 | Yu | |
| 5,353,985 | A | 10/1994 | Nageli et al. | |
| 5,385,294 | A | 1/1995 | Andersson et al. | |
| 5,388,699 | A | 2/1995 | Ratajczak | |
| 5,499,738 | A | 3/1996 | Burleigh | |
| 5,630,523 | A | 5/1997 | Wright et al. | |
| 5,664,671 | A | 9/1997 | Nedblake et al. | |
| 5,669,523 | A | 9/1997 | Mueller et al. | |
| 5,692,626 | A * | 12/1997 | Wehrle | B65D 23/10 215/6 |
| 5,722,540 | A | 3/1998 | Laird et al. | |
| 5,731,020 | A | 3/1998 | Russo et al. | |
| 5,803,294 | A | 9/1998 | Bello et al. | |
| 5,954,213 | A | 9/1999 | Gerhart et al. | |
| 6,105,812 | A | 8/2000 | Riordan | |
| 6,138,899 | A | 10/2000 | Grabher et al. | |
| D434,312 | S | 11/2000 | Pegler | |
| 6,145,685 | A | 11/2000 | Dick et al. | |
| 6,179,146 | B1 | 1/2001 | Betras et al. | |
| 6,196,412 | B1 | 3/2001 | Cattell et al. | |
| 6,415,940 | B1 | 7/2002 | Brabson et al. | |
| 6,450,351 | B1 * | 9/2002 | Thompson | B65D 1/04 215/6 |
| 6,499,614 | B1 | 12/2002 | Thompson | |
| 6,708,735 | B1 | 3/2004 | Kenihan | |
| 6,723,360 | B1 | 4/2004 | Dunaway et al. | |
| 6,955,028 | B1 | 10/2005 | Dunaway et al. | |
| 6,971,521 | B2 | 12/2005 | Pinyot et al. | |
| 7,516,596 | B2 | 4/2009 | Henderson et al. | |
| 7,571,829 | B2 | 8/2009 | Gersovitz | |
| 8,449,186 | B2 | 5/2013 | Bray | |
| 8,915,395 | B2 | 12/2014 | Gersovitz | |
| 2001/0030134 | A1 | 10/2001 | Goglio et al. | |
| 2001/0040164 | A1 | 11/2001 | Cleator et al. | |
| 2002/0088730 | A1 | 7/2002 | Galomb | |
| 2002/0130126 | A1 | 9/2002 | Rosenberg | |
| 2004/0121047 | A1 | 7/2004 | Cohen | |
| 2004/0159625 | A1 | 8/2004 | Kwon et al. | |
| 2004/0231111 | A1 | 11/2004 | Martinez | |
| 2005/0173501 | A1 | 8/2005 | Jones | |
| 2006/0219719 | A1 | 10/2006 | Dixon | |
| 2006/0257534 | A1 | 11/2006 | Maddock | |
| 2007/0012710 | A1 | 1/2007 | Vovan et al. | |
| 2007/0267416 | A1 | 11/2007 | Eichenbaum | |
| 2009/0236346 | A1 | 9/2009 | Hofeldt et al. | |
| 2009/0241477 | A1 | 10/2009 | Gersovitz et al. | |
| 2010/0065557 | A1 | 3/2010 | Gersovitz | |
| 2010/0142861 | A1 | 6/2010 | Sam | |
| 2010/0142862 | A1 | 6/2010 | Sam | |
| 2010/0159096 | A1 | 6/2010 | Sam | |
| 2011/0253725 | A1 | 10/2011 | Killian | |
| 2011/0284550 | A1 | 11/2011 | Gersovitz | |

OTHER PUBLICATIONS

Non-Final Office Action dated Jul. 15, 2014 for U.S. Appl. No. 12/622,853, 9 pages.

Notice of Allowance dated Nov. 3, 2014 for U.S. Appl. No. 12/622,853, 7 Pages.

Final Office Action dated Feb. 12, 2013 in U.S. Appl. No. 12/622,853, 8 pages.

Office Action dated Sep. 11, 2012 in U.S. Appl. No. 12/622,853, 6 pages.

Final Office Action dated Sep. 23, 2014 for U.S. Appl. No. 13/093,468, 10 pages.

Non-Final Office Action dated May 8, 2014 for U.S. Appl. No. 13/093,468, 11 pages.

Non-Final Office Action dated May 1, 2015 for U.S. Appl. No. 13/093,468, 9 pages.

Office Action dated Feb. 12, 2013 for U.S. Appl. No. 13/093,468, 14 Pages.

Office Action dated Jul. 23, 2012 for U.S. Appl. No. 13/093,468, 9 pages.

Office Action dated Jul. 2, 2014 for Canadian Patent Application No. 2,737,981, 1 page.

Office Action dated Feb. 3, 2014 for Canadian Patent Application No. 2,737,981, 2 pages.

Office Action dated Sep. 6, 2012 in Canadian Patent Application No. 2,737,981, 2 pages.

Office Action dated May 31, 2013 for Canadian Patent Application No. 2,737,981, 4 pages.

PCT/US2017/040583 , "International Search Report and Written Opinion", Nov. 30, 2017, 6 pages.

* cited by examiner

MULTI-COMPARTMENT CONTAINERS

CROSS-REFERENCES TO RELATED APPLICATIONS

This application claims the benefit of U.S. Provisional Patent Application No. 62/357,644, filed Jul. 1, 2016, entitled "MULTI-COMPARTMENT CONTAINERS", This application is further a continuation-in-part of U.S. patent application Ser. No. 14/693,765, filed Apr. 22, 2015, entitled "MULTI-COMPARTMENT CONTAINERS", which is a divisional of U.S. patent application Ser. No. 13/093,468, filed Apr. 25, 2011, entitled "MULTI-COMPARTMENT CONTAINERS", which claims the benefit of U.S. Provisional Patent Application No. 61/345,974, filed May 18, 2010.

This application is also related to U.S. patent application Ser. No. 12/622,853, filed Nov. 20, 2009 (now U.S. Pat. No. 8,915,395), which is a continuation-in-part of U.S. patent application Ser. No. 12/415,910, filed Mar. 31, 2009 (now abandoned), which is a divisional application of U.S. patent application Ser. No. 10/948,837, filed Sep. 22, 2004 (now U.S. Pat. No. 7,571,829), which claims the benefit of U.S. Provisional Patent Application No. 60/505,410, filed on Sep. 23, 2003. The disclosures of these applications are all incorporated herein by reference in their entirety for all purposes.

BACKGROUND

Embodiments of the present invention relate to packaging for consumer and commercial products that can lose potency or freshness when the package is opened and the contents are exposed to atmospheric conditions, such as oxygen and moisture in air. While such problems are present in traditional sizes and portions, they are a particularly pronounced in products that are typically purchased in larger sizes or "economy" sizes or take some amount of time to use or consume once the package has been opened. The amount of product or size of the portion can depend on the nature of the product. For example, ground coffee can quickly lose its scent and flavor when exposed to air and bread can become stale when exposed to air; while other goods, such as rice and beans, are much more stable when exposed to air. Other products can begin losing potency immediately upon exposure to air. Accordingly, the amount of the product that might be considered "economy" size can vary with the type of the product and its ability to maintain freshness upon exposure to air.

One particular problem with "economy" size single compartment packaging is that the entirety of the contents is exposed to the air once the package is opened for the first time and each time the package is accessed to remove more product. As such, the possible savings realized on a per serving or per use basis can be and are often lost due to spoilage or staleness of at least some of the product if not used in a timely manner. This problem is only exacerbated by the mandatory or voluntary removal of preservatives from many products and food stuffs FIG. 1 shows three examples of conventional packages or containers that are used for consumer and commercial products. Typical cans or canisters, represented by can 105, are available in various sizes and proportions and made of various materials, such as metal, plastic, cardboard, paperboard, foil, Mylar™, or a composite of any of the foregoing. Conventional boxes or cartons, such as box 110, similarly, are available in various sizes and proportions and made of various materials, such as metal, plastic, cardboard, paperboard or a composite or combination of any of the foregoing. Conventional bags, such as bag 115, also are available in various sizes and proportions and made of various materials, such as paper, plastic, Mylar™, foil or a combination of any of the foregoing. Plastics can include traditional variations of polyethylene. Each of can 105, box 110 and bag 115 are single compartment containers. As such each exhibit a similar problem with single compartment containers in that once they are opened, the entire contents of the container are exposed to air and moisture.

As known, exposure to air and moisture can cause many products, such as food stuffs, to lose freshness or go stale. To avoid continued exposure to air and moisture, some configurations of can 105, box 110 and bag 115 include re-sealable or reusable lids and closures. For example, can 105 might include a reusable plastics lid, box 110 might include a re-sealable top having some type of reusable adhesive, while bag 115 might be equipped with a re-sealable or reusable closure like a zipper or a clip. However, such re-sealable or reusable closures still allow the entirety of the remaining contents to be exposed to new air and moisture each time the package is opened to access the product.

As individuals, families and businesses increasingly purchase staple and other products in "bulk" or "economy" sizes or portions, there is a need to preserve the freshness and potency of products after the package is opened and until the product is used, consumed or depleted. Embodiments of the present invention address these and other issues.

BRIEF SUMMARY

Some embodiments are directed toward a multi-compartment container having a first compartment and a second compartment, wherein the first compartment and the second compartment can be separately filled with a product and separately sealed.

Some embodiments directed toward a multi-compartment container wherein the first and second compartments are defined by a box or a carton having an internal divider.

Some embodiments are directed toward a multi-compartment container wherein the first and second compartment are defined by a bag having a first sealed end, a second sealed end and a divider seal disposed between the first sealed end and the second sealed end and separating the first and second compartments.

Some embodiments are directed toward a method of using a multi-compartment container. The method includes obtaining a multi-compartment container having a product packaged in two or more compartments and opening a first compartment to access the contents. The contents of the first compartment can then be used until depleted. When the contents of the first compartment are depleted, a second compartment is opened to access the contents of the second compartment.

According to some embodiments of the invention, a multi-compartment storage device is provided. The multi-compartment storage device includes a top surface and a bottom surface positioned opposite to the top surface. The multi-compartment storage device further includes a front surface connecting the top surface to the bottom surface. The multi-compartment storage device further includes a rear surface connecting the top surface to the bottom surface and positioned opposite to the front surface. The multi-compartment storage device further includes a first lateral surface extending from the bottom surface to the top surface and connecting the front surface to the back surface. The multi-compartment storage device further includes a second lateral surface positioned opposite to the first lateral surface and extending from the bottom surface to the top surface. The second lateral surface connects the front surface to the back surface. The multi-compartment storage device further includes a first spout extending from the first lateral surface, the top surface, the front surface, and the rear surface. The multi-compartment storage device further includes a second spout extending from the second lateral surface, the top surface, the front surface, and the rear surface. The multi-compartment storage device further includes a divider extending from the bottom surface to the top surface and connecting the front surface to the rear surface. The divider divides the multi-compartment storage device into a first compartment and a second compartment.

DETAILED DESCRIPTION

Some embodiments of the present invention are directed toward multi-compartment containers and packages that can be used to help better preserve the freshness and potency of consumer and commercial products. In particular, some embodiments of the present invention are directed to multi-compartment bags, pouches, boxes, cartons, cans and canisters that allow users to access and use a portion of the product contained therein while keeping one or more portions of the product sealed in the same state as it was originally packaged. In particular, the multi-compartment storage devices or containers may include at least two compartments in which sundry consumer and commercial products can be packaged in multiple portions, thus protecting a closed portion of the product from environmental conditions, such as air and moisture, while the opened portion is used.

According to various embodiments, compartments can be filled by a manufacturer, packager or reseller with at least one product that may be susceptible to loss of freshness or potency when exposed to environmental conditions outside of the multi-compartment container. The size of the compartments in the multi-compartment container can be the same or different. The size of each compartment of the multi-compartment container can be based on the nature of the packaged contents. For example, products such as cereal, which have a moderate resistance to becoming stale, might be packaged in a compartment of one multi-compartment container that is larger than the compartment in another multi-compartment container used to package baking soda, which may be highly susceptible to loss of potency. In some embodiments, the more susceptible a product is to loss of freshness or potency, the more it become desirable to package it in a smaller compartment of multi-compartment container, so as to protect the remaining product in the other compartment of the multi-compartment container.

Figure 1:
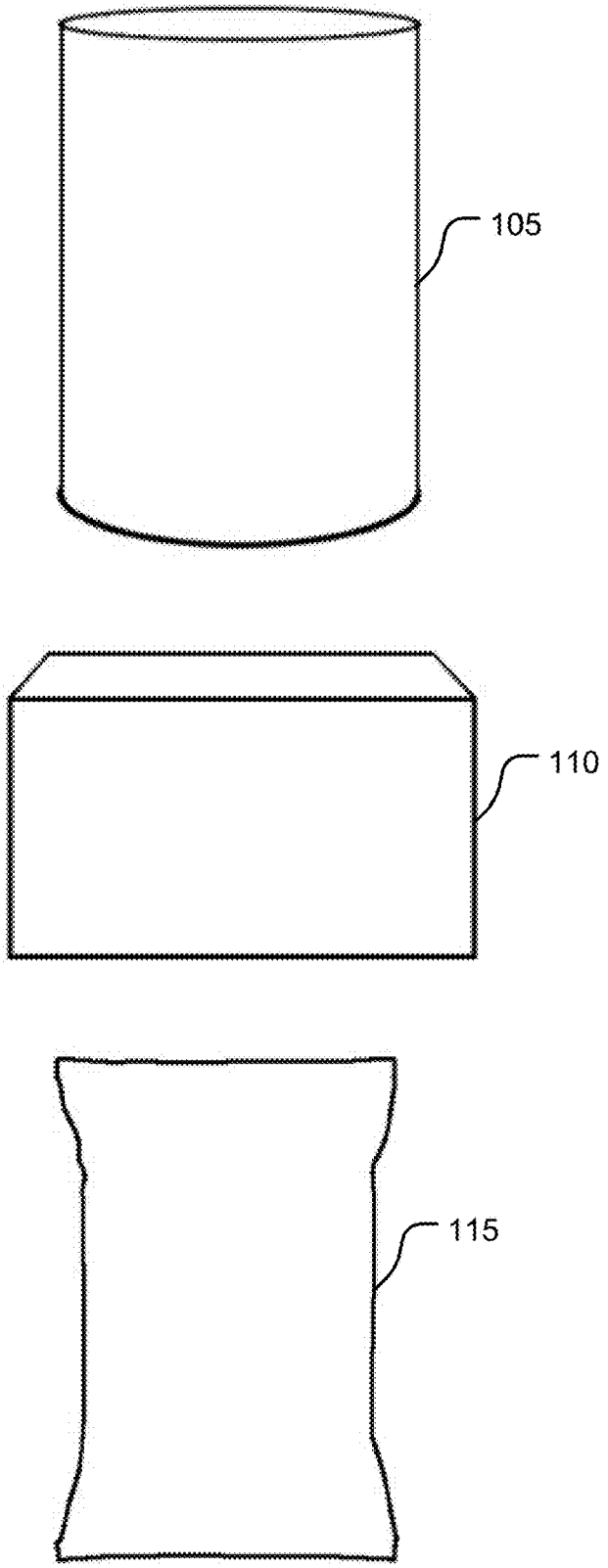
FIG. 1 shows three types of conventional packages that can be improved by various embodiments of the present invention.
Figure 2:
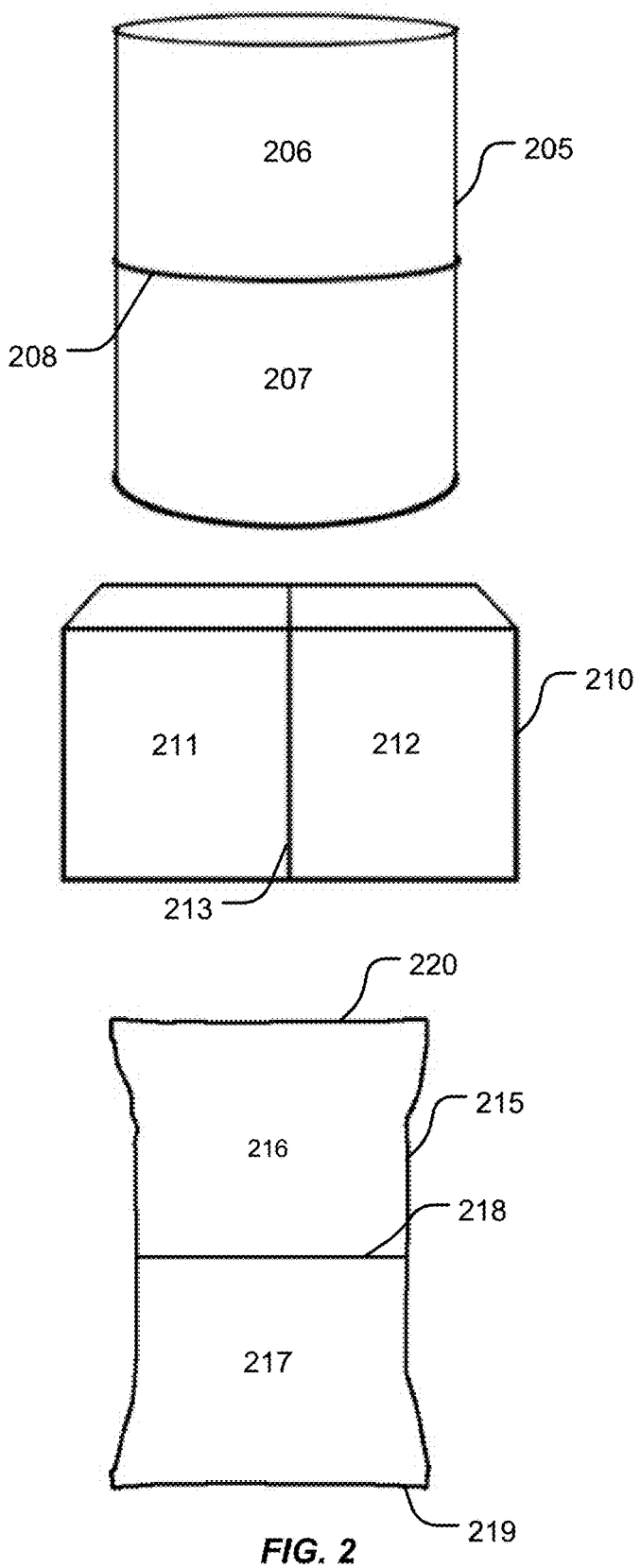
FIG. 2 shows three examples of multi-compartment versions of the packages shown in FIG. 1, as improved by various embodiments of the present invention.

FIG. 2 shows improvements to the can or canister 105, box 110 and bag or sack 115 as shown in FIG. 1, in accordance with some embodiments. The illustrations of multi-compartment can 205, multi-compartment box 210 and multi-compartment bag 215 show the improvements according to various embodiments of the present invention. Each of the varieties of the multi-compartment containers shown in FIG. 2 can be made of various materials and may include various seals and lids (one time use or reusable) based on the type of product that they will be used to package. The seals used to seal the separate compartments may be the same or different, and each compartment may include one or more seals. Furthermore, although the examples shown FIG. 2 each have two compartments, various embodiments of the present invention can include more than two compartments with separate or shared seals and/or lids.

Can 205 may include two compartments 206 and 207. In some embodiments, compartments 206 and 207, as well as other compartments in other embodiments, may be separately manufactured and then attached to one another. In such embodiments, each compartment can be a full or partial container with or without a full set of sides/walls, top and bottom. Such embodiments are described in more detail in U.S. Pat. No. 7,571,829 and U.S. patent application Ser. No. 12/622,853, herein incorporated by reference in their entirety. In some embodiments, compartments 206 and 207 of can 205 can be made of a single cylindrical or other shape outer body with an interior divider wall 208. In some examples, can 205 (including interior divider wall 208) may be formed as a single unitary body. In some examples, compartments 206 and 207 may be formed as a single unitary body, with the interior divider wall 208 being formed separately and being attached according to any method to the compartments 206 and 207.

The divider wall 208 can be oriented in any plane within can 205. In some embodiments, can 205 can include more than two compartments. In some embodiments, the divider wall 208 can affixed to the interior wall of a cylinder, while in other embodiments the divider wall 208 can be included in the exterior structure of the can 205. In such embodiments, the divider wall 208 can be used to connect two cylinders of similar or dissimilar materials having either the same or different volumes. The divider wall 208 can be made of the same or one or more different materials than those used to form compartments 206 and 207. In some embodiments, more than one divider wall 208 may be implemented in can 205, depending on the number of desired compartments.

Similarly, the divider wall 208 can have any shape to accommodate various products or the divide up the volume of the multi-compartment container into structurally or visually interesting or aesthetic volumes. For example, divider wall 208 need not be a flat disc. For the purposes of reducing the material needed to manufacture the divider wall 208, divider wall can include stamped or molded ribs to increase the structural integrity. In some embodiments, the divider wall 208 can be in the shape of a cone, a parabolic rotation, or bubble shape with at least one plane, edge or rim that can connect to the wall of can 205. Such configurations can provide novel ways to divide the interior volumes of the multi-compartment container. Such embodiments can be particularly desirable for multi-compartment containers with transparent or translucent side walls, such that the divider and the separate volumes within the multi-compartment container can be seen or observed from the exterior of the multi-compartment container. Although shown and described as being generally horizontally oriented with respect to can 205, it is contemplated that in some embodiments, the divider wall 208 may be oriented vertically with respect to can 205 and/or at any angle across can 205.

According to various embodiments of the present invention, box 210 can include at least two compartments, such as 211 and 212. Box 210 can also include more than two compartments. Similar to box 110, box 210 can be made of various materials. For example, the walls, sides, top and bottom of box 210 can include cardboard, paperboard, metal, wood, plastic, foil, Mylar™ or some composite or combination of the foregoing materials. Any material suitable for making walls, sides, top and bottom rigid enough to contain the intended contents of box 210 can be used.

Compartments 211 and 212 may be constructed of the same or different materials. In some embodiments, box 210 having compartments 211 and 212, can be constructed of a single piece of cardboard, paper or paperboard, or plastic using box folding pattern and construction techniques. In some embodiments, box 210 can be constructed by joining two separate boxes having compartments 211 and 212, respectively. In some embodiments, box 210 can include a divider 213 affixed to the interior of box 210. The divider 213 may define compartment 211 and 212 with the same or different volumes. According to some embodiments, box 210 can have more than two compartments. The divider 213 may be oriented in any plane within box 210, including planes parallel or perpendicular to the long or short axes of the box 210 (e.g., horizontally, vertically, and/or at an angle). Divider wall 213 may also have any shape suitable for separating the volumes of compartment 211 and 212. Box 210 may include multiple divider walls 213 in some embodiments, depending upon the number of compartments desired.

In various embodiments, compartments 211 and 212 can be used to package the same or different products, materials or food stuffs. Each compartment 211 and 212 can be opened, unsealed or accessed individually in some embodiments. The compartments 211 and 212 may each include one seal or multiple seals. For example, the compartments 211 and 212 may each include a one-time use seal. In another example, the compartments 211 and 212 may each include a one-time use seal covered by a reusable lid. In some embodiments, the compartments 211 and 212 may include different seals. For example, the compartment 211 may include a one-time use seal, while the compartment 212 may include a reusable seal. The type of seal(s) needed may depend upon the type of product being packaged in each compartment.

In some embodiments, while the contents of one compartment are in the process of being used or consumed, the contents of the other compartment remain sealed to protect freshness or potency. Such configurations have the advantage of providing larger quantities of the product to be packaged and sold with less potential of the contents losing freshness or potency due to exposure to air. From a consumer point of view, economical quantities of products can be purchased with a lower chance that the purchased product be lost to waste. These advantages provide potential for greater profitability on the side of the manufacturer or packager by creating a more desirable packaged product and thus higher demand, at the same time as providing potential cost savings of bulk quantity purchases for the user or consumer. As used herein, the term "consumer" may include any type of entity, including, but not limited to, individuals, families, restaurant, food preparation professionals, chefs, workers, hospitals, hotels, etc.

Also shown in FIG. 2 is bag 215. As shown, bag 215 can have two compartments 216 and 217. In some embodiments, compartments 216 and 217 can be formed by crimping, sewing or heat welding the non-rigid or semi-rigid walls of bag 215 at seam 218. The non-rigid or semi-rigid walls of bag 215 can include paper, plastic film, foil, Mylar™, cellulose or some combination or composite thereof, and like materials. Bag 215 may have its top and bottom end seams 219 and 220 sealed in the same or a different manner than the seam 218. In some embodiments, seam 218 can be oriented in the longitudinal direction running from end 219 to 220. In some embodiments, ends 219 and 220 may include re-closable seams or seals, such as zipper-type or reusable adhesive-type closures. As described with respect to box 210, ends 219 and 220 may include the same or different seals, and/or may include multiple seals.

Figure 3:
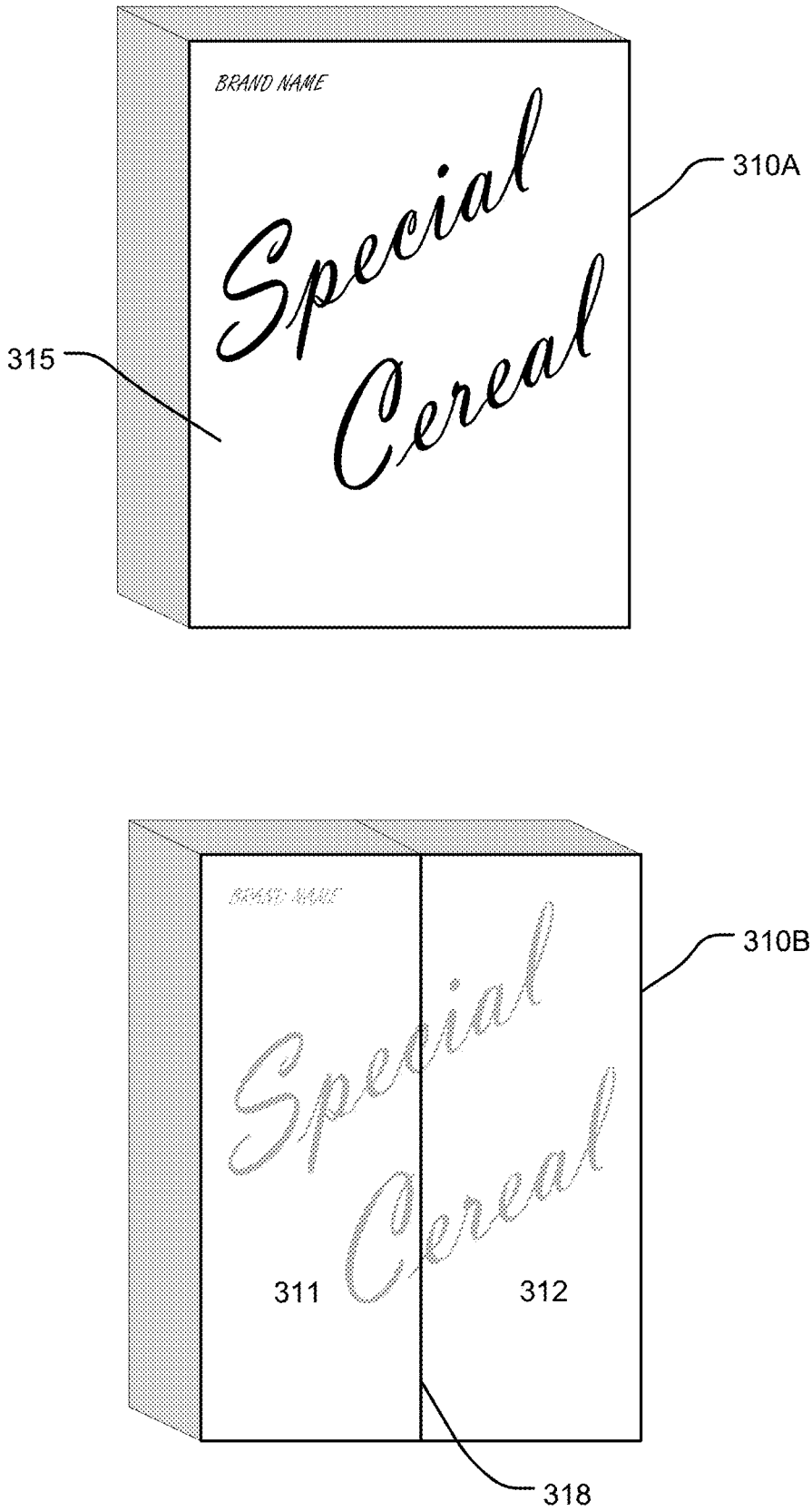
FIG. 3 shows a multi-compartment box according to some embodiments of the present invention.

FIG. 3 shows an example of a multi-compartment cereal box 310A according to some embodiments of the present invention. Cereal box 310A may include compartments 311 and 312. The construction of cereal box 310A may include the same or different materials as described above in reference to box 210, or any other suitable material. Compartments 311 and 312 can be constructed of or include the same or different materials as each other.

In various embodiments, a consumer can access and use the contents of compartment 311 without exposing the contents of compartment 312. Once the contents of compartment 311 are depleted, a user can open or unseal compartment 312 to access the contents of that compartment. Each of compartment 311 and 312 may include desiccants in some embodiments. Compartments 311 and 312 may include liners, or re-sealable or reusable lids or closure elements for creating an airtight or hermetic enclosure, separate from the airtight or hermetic enclosure of the other compartment of the multi-compartment container in some embodiments.

Although cereal box 310A is shown and described as a cereal box, this example is only illustrative and should not be construed as limiting a box such as 310A to being only used for packaging cereal. Cereal box 310A, as well as any other containers according to other embodiments, may be used to package numerous types of dry food, commercial or industrial products, including products that are sensitive to air, such as grains, chips, marshmallows, pretzels, nuts, dried fruit, oats, weight control supplements, protein powders, milk additives, such as chocolate milk powder, plaster of Paris, baby food, cookies, crackers, baking mixes, pancake mixes, cake mixes, brownie mixes, drink mixes, car wax, greases, sealants, epoxies, glues, cigars, cigarettes etc.

As shown, the cereal box 310A may have an exterior surface or face 315. Exterior surface 315 may include a material identical to that of cereal box 310A or comprise a wrapper made of a different material. For example, the body of cereal box 310A can be made of cardboard or a composite of cardboard and plastic, while the exterior surface 315 can be or wrap made of plastic film or a separate piece of paper wrapped around or otherwise affixed to cereal box 310A. In some embodiments, it is desirable for the exterior 315 to have printed information to identify the contents and the proper use of the contents of cereal box 310A and its constituent compartments 311 and 312.

Box 310B shows the interior construction of cereal box 310A. As shown, box 310B includes a divider 318 separating compartments 311 and 312. Divider 318 can be oriented in any direction, including, but not limited to, vertical, horizontal or angled with respect to the orientation of the packaging. Divider 318 can be integral to the construction of the box 310B or can be a separate piece and even be made of a different material than the exterior 315, walls, sides, top and bottom of box 310B. In some embodiments, it may be beneficial for the material of box 310B to include a composite material to further insure freshness and potency of the contents of compartments 311 and 312. To that end, it may be desirable to use a cardboard or paperboard laminated or other material combined with a plastic or Mylar™ type product in the construction of box 310B.

Figure 4:
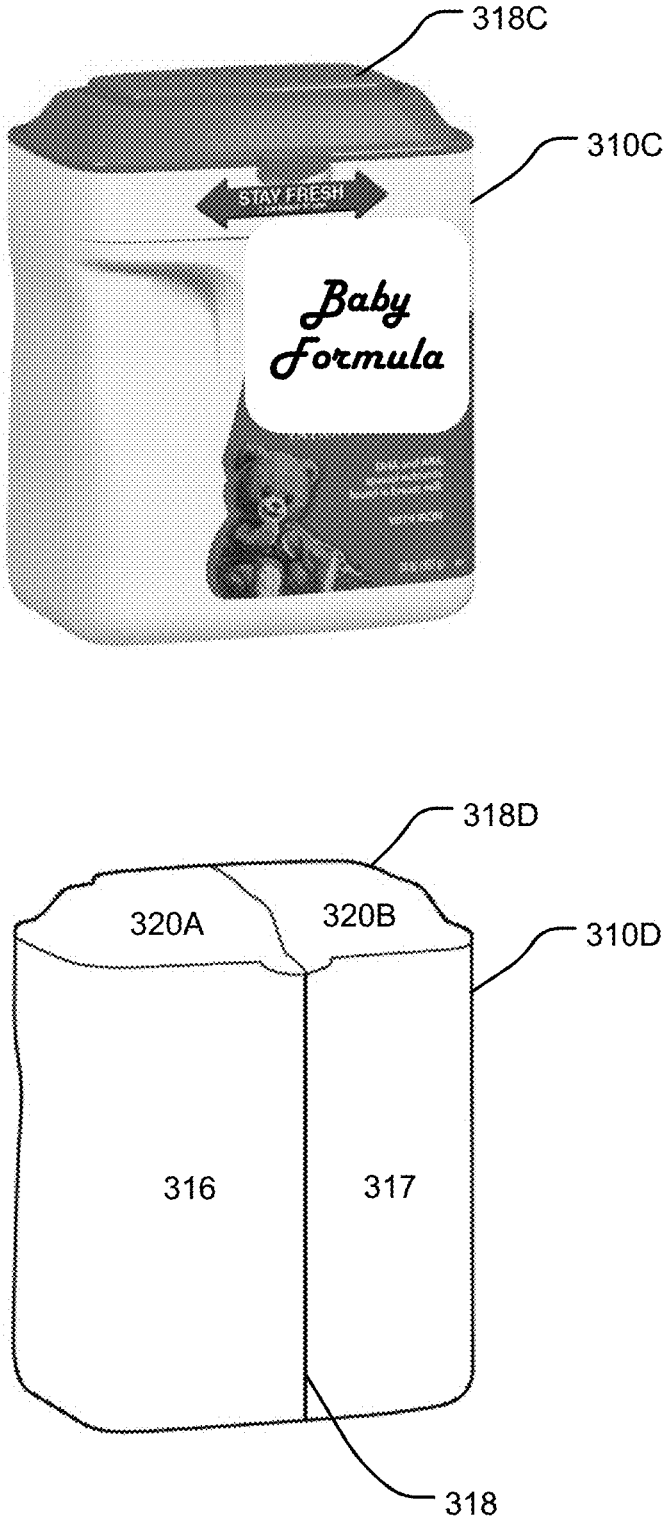
FIG. 4 shows a multi-compartment container according to some embodiments of the present invention.

Various other boxes and containers according to various embodiments of the present invention can be made of waterproof or moisture resistant materials such as plastic. Such embodiments may be advantageous when the contents of multiple compartments of the containers described herein are wet or moist. For example, multi-compartment containers according to some embodiments may be useful for dispensing one portion of pre-moistened wipes while keeping another portion fresh and moist for future use. Such wipes can include fabric or paper based towels pre-moistened or laced with solutions, detergents, and/or medications for personal care and hygiene or household or industrial use. Some embodiments include wipes, moistened disinfectants, cleaners, polishes, waxes, soaps, or medications and topical solutions such as make-up removers, skin treatments, moisturizers and sanitary solutions. FIG. 4 shows one example of a plastic box 310C according to some embodiments of the present invention that may be suitable for packaging dry or wet products. As with the container shown in FIG. 3, the divider wall 318 in FIG. 4 may also be disposed in any orientation with respect to the other surfaces of the container, such as horizontally, vertically, at an angle, or combinations thereof.

By using an appropriate plastic or other polymer, box 310C can be used to package or contain various types of liquids and wet products that require special handling or an airtight seal to maintain usefulness. The airtight seal afforded by using a plastic material for the body and lid 318C for box 310C may be useful in other applications as well. Plastic materials may be useful for making reusable and re-sealable or reusable lids or closure elements such as lid 318C. Such types of re-sealable lids or closure elements are useful for products that are used frequently or when the container is required to withstand being transported after the container is opened. For example, box 310C can be used to package products such as wet or dry baby formula that must survive being carried in a carry bag with other supplies on a regular basis, while protecting the baby formula from contamination and preventing the baby formula from spilling. Such containers may also be useful for frequently used and moisture sensitive products, such as powdered drinks, iced-tea and chocolate milk mixes.

Box 310D shows the internal construction of box 310C. As shown, box 310D may include compartments 316 and 317 that can be individually sealed with re-sealable lids 320A and 320B that make up lid 318D. In some embodiments, lids 320A and 320B can be opened and closed as a single unit or operated independently as individual lids. In some embodiments in which lid 318D operates as a single piece, compartments 316 and 317 can be sealed by an additional and separately openable seal, such as a one-time use foil or plastic seal applied at the packaging facility to one or both compartments 316 and 317. In some embodiments, lids 320A and 320B can be operated independently of one another and perform as the factory seal and the re-sealable lid for compartments 316 and 317 respectively.

In some embodiments, box 310C and 310D can be molded as a single piece or can include multiple separately molded pieces that can be adhered, welded or otherwise affixed to one another to form a multi-compartment box. In some embodiments, it may be desirable for box 310C and box 310D to include pour spouts or anti-drip spouts to prevent spills or protect the outside of the box from being contaminated or stained by the contents contained in compartments 316 and 317. Although only two compartments are described in reference to the boxes 310C and 310D in FIG. 4, some embodiments contemplate more than two compartments.

Figure 5:
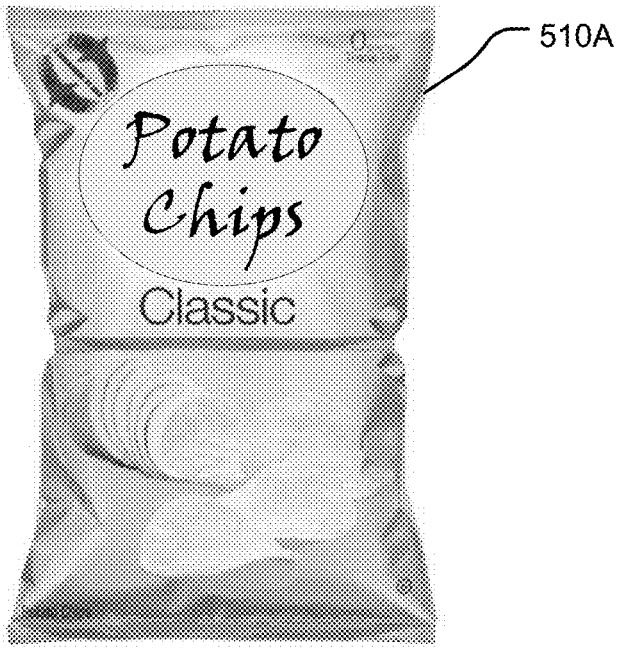
FIG. 5 shows a multi-compartment bag according to some embodiments of the present invention.
Figure 5:
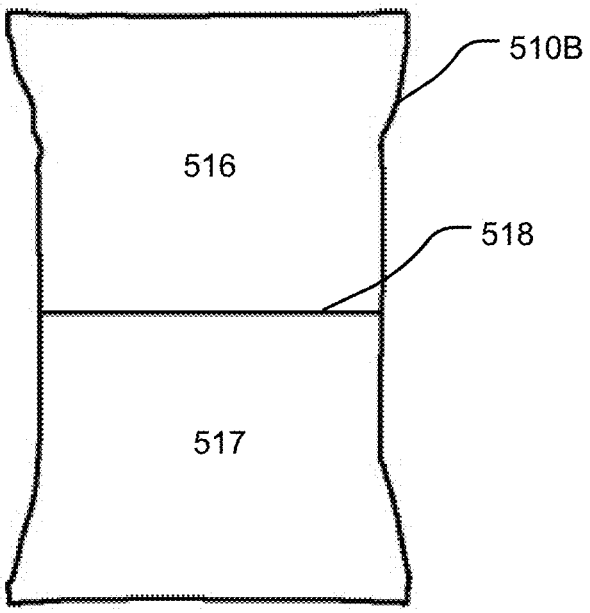

FIG. 5 shows a multi-compartment bag according to some embodiments of the present invention. Bag 510A can have sides or walls made of any suitable non-rigid, semi-rigid or rigid material for containing and maintaining freshness of the intended contents. For example, the material of the walls of bag 510A can include plastic, plastic film, Mylar, paper or biodegradable or compostable cellulose, other like suitable materials, and/or combinations thereof. In some embodiments, the material of the walls or sides of bag 510A can include any type of flexible, non-rigid or semi-rigid material. The materials of the walls or sides of bag 510A may be the same or different. Bag 510B shows the internal construction of bag 510A.

As shown, bag 510B can include compartments 516 and 517 divided by dividing seam 518. As in other embodiments of the present invention, compartments 516 and 517 can be used to contain or package the same or different materials from one another. Seam 518 can be formed in bag 510B to define separate compartments 516 and 517. As described herein with respect to other embodiments, seam 518 may be oriented in any position and/or shape, such as horizontally, vertically, at an angle, or in a particular design. Bag 510B can include compartments 516 and 517 as two separately openable pouches each having a separate portion of product therein. However, as described herein, bag 510B may include more than two compartments forming multiple separately openable pouches. Seam 518 can be formed by crimping, sewing, welding or adhering the walls of bag 510B to one another to form two compartments 516 and 517. In some embodiments, seam 518 can include perforations that can be used to detach one of the compartments from the other compartments once the contents of one of the compartments is depleted. In such embodiments, the multi-compartment bag 510B can be reduced in size as the contents are used to save storage space and for the convenience of the user.

Thus, according to some embodiments, users or consumers can open and access the contents of each compartment or pouch individually, while maintaining the freshness of the contents of the other pouch until the contents of the first pouch are depleted. Bags 510A and 510B can be used to package various types of materials, products and foodstuffs. For example, bag 510A can be used to package foods such as potato chips, pretzels, nuts, hot dogs, salad and other foods that are susceptible to spoilage or staleness upon exposure to air and/or moisture.

Figure 9:
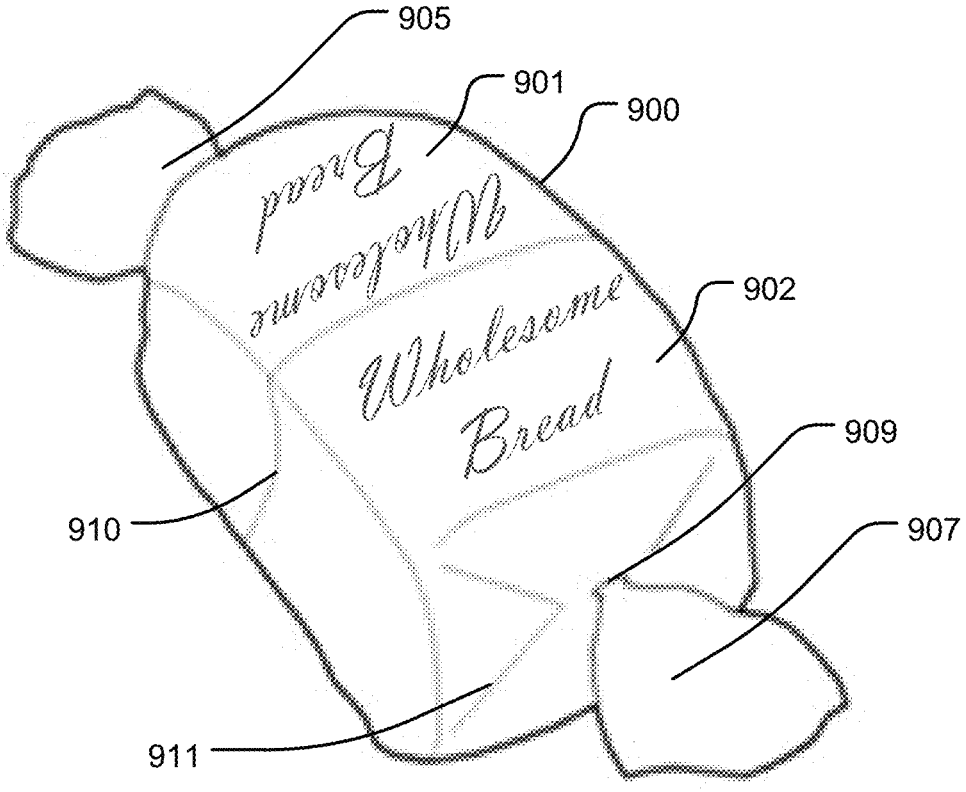
FIG. 9 shows a multi-compartment bag according to some embodiments of the present invention.

In some embodiments, such as the embodiments shown in FIG. 9, each compartment of a multi-compartment bag can contain a full or partial loaf of sliced or unsliced bread. In embodiments directed toward packaging bread shown in FIG. 9, the divider 910 that separates compartments 901 and 902 of multi-compartment container 900 can be a sheet of similar or dissimilar material as the walls of the multi-compartment bag to provide a less constricting volume within each compartment. Such dividers can be constructed according to various methods of attaching and pleating the bag material. The pleats of divider 910 can be similar to pleats 911 in some embodiments. In some embodiments, the pleats of divider 910 may be manufactured into the divider 210, while the pleats 911 are naturally formed by closing the compartments 901, 902 with their respective closures. The openable portions 905 and 907 of the multi-compartments can include various closure systems to help preserve the freshness of the contents. Such closures can include twist ties 909, clips, and zip type seals. Although shown as dividing the multi-compartment container 900 instead two similarly sized compartments 901, 902, it is contemplated that the divider 910 may be positioned anywhere along the multi-compartment container 900 to form compartments of different sizes.

In some embodiments, bag 510A can be used to package refill portions of regularly used household goods such as dish, laundry and hand soap, as well as condiments such as ketchup, mustard, relish or mayonnaise. In such embodiments, the use of a bag 510A can help reduce the amount of packaging required for distributing regularly used household goods, while also providing users and consumers with an economical quantity discount.

Figure 6:
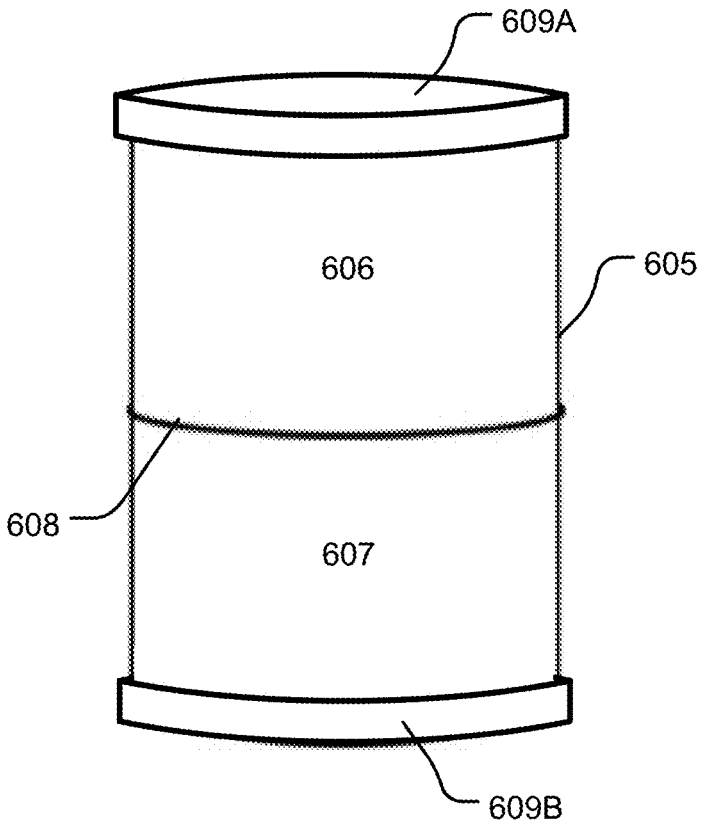
FIG. 6 shows a multi-compartment can or canister according to some embodiments of the present invention.

FIG. 6 shows a multi-compartment container 605. For example, the multi-compartment container 605 may be used for packaging ice cream. In some embodiments, multi-compartment container 605 can include compartments 606 and 607 that can each contain a portion of ice cream, for example. Each compartment 606 and 607 may be separate from one another by divider 608, as described above with reference to FIG. 2. Each compartment 606 and 607 may be sealed with a plastic film, foil or Mylar™ single use cover and, in some embodiments, may also or alternatively include a reusable lid 609A or 609B, respectively. The single use seals may allow a consumer to open only one portion of ice cream contained in multi-compartment container 605, thus protecting the unopened portion from freezer burn or the formation of ice crystals that can develop despite the use of the reusable lids 609A and 609B, and thus prevent the degradation of the flavor and texture of ice cream.

Figure 7:
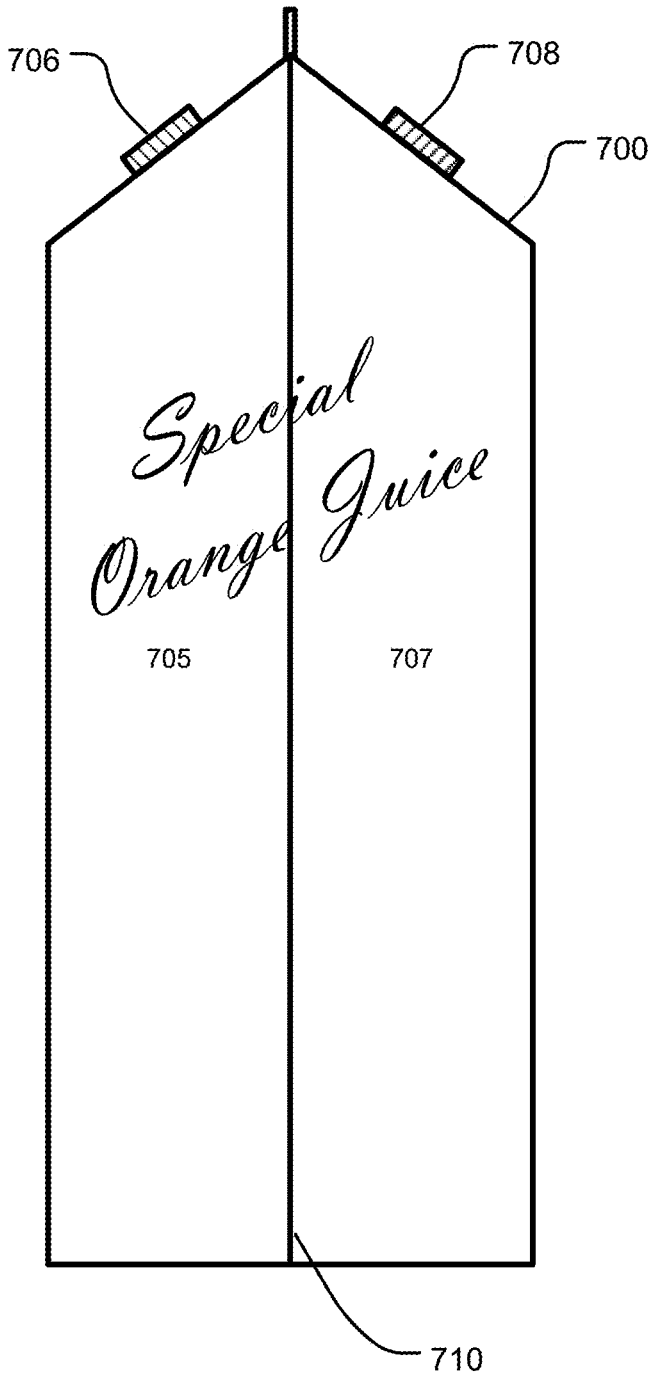
FIG. 7 shows a multi-compartment carton according to some embodiments of the present invention.

FIG. 7 shows another example of a multi-compartment container 700 in accordance with some embodiments. In some embodiments, multi-compartment container 700 may be a composite container for beverages or other liquids, such as dairy products like milk, cream, half and half, buttermilk, etc., as well as fruit and vegetable juices, soy milk, almond milk, peanut milk, and other specialty beverages. The multi-compartment container 700 may include at least two compartments 705 and 707 separated by divider 710. Although shown as being oriented vertically, it is contemplated that divider 710 may have any orientation. The compartments 705, 707 may include lids 706 and 708, respectively, which may be screw top caps in some embodiments. Multi-compartment container 700 may include an integrated construction, or may include two separately formed containers that may be joined together along divider 710. Multi-compartment container 700 may include any combinations of the aforementioned materials suitable for containing the product intended to be stored therein, e.g., liquids.

Figure 8:
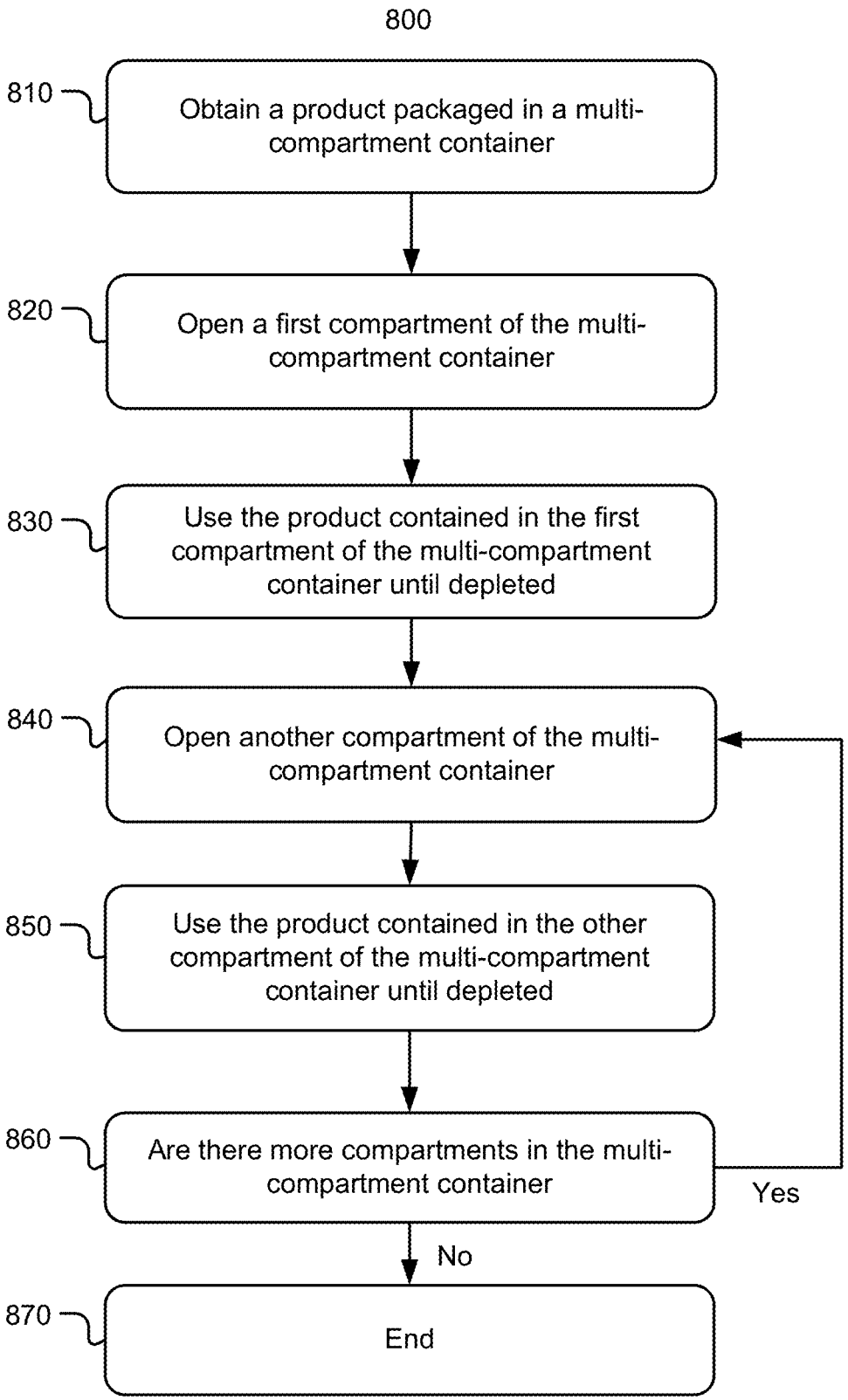
FIG. 8 shows a flowchart of a method for using a multi-compartment container according to some embodiments of the present invention.

FIG. 8 is a flowchart of a method 800 for using a multi-compartment container according to some embodiments of the present invention. At step 810, the consumer can obtain a product packaged in a multi-compartment container. In some embodiments, obtaining a packaged product having a multi-compartment container includes buying a product at a store or ordering a product online, while in some embodiments, the user can reuse a multi-compartment container refilled with the contents of his or her choice. A multi-compartment container can be used for home canning purposes in some examples.

At step 820, a user may open one of the compartments of the multi-compartment container as described with respect to FIGS. 1-5. The contents of the first compartment of the multi-compartment container can be used either all at once or incrementally, as the contents of the multi-compartment container are needed. If the contents of the multi-compartment container are being used incrementally, the time required to complete the contents of the first compartment may be such that if the entirety of the contents of the container were exposed to air and moisture, the quality, freshness or potency of the contents might be compromised if they were not sealed in the second compartment.

In step 830, a user may use the product contained in the first compartment of the multi-compartment container until it is depleted. At some point, the user may open a second compartment of the multi-compartment container at step 840. The user may open the second compartment once the first compartment is depleted or at any other suitable point. For example, the user may open the second compartment before the first compartment is depleted if the second compartment includes different contents than the first compartment. The contents of the second compartment of the multi-compartment container can be used until it is depleted in step 850. Once the product contained in the second compartment of the multi-compartment container is depleted, the user can then use any other available compartments of the multi-compartment container still containing product, such as when the multi-compartment container includes more than two separate compartments.

At step 860, if there is yet another compartment of the multi-compartment container that still contains product, the user can repeat steps 840 through 860 until no product remains in any compartments of the multi-compartment container. Once all contents of the multi-compartment container are depleted, the user can discard, reuse or recycle the multi-compartment container in step 870.

Configurations may be described herein as a process which is depicted as a flow diagram or block diagram, such as in FIG. 8. Although each may describe the operations as a sequential process, many of the operations can be performed in parallel or concurrently. In addition, the order of the operations may be rearranged. A process may have additional steps not included in the figure.

Figure 10:
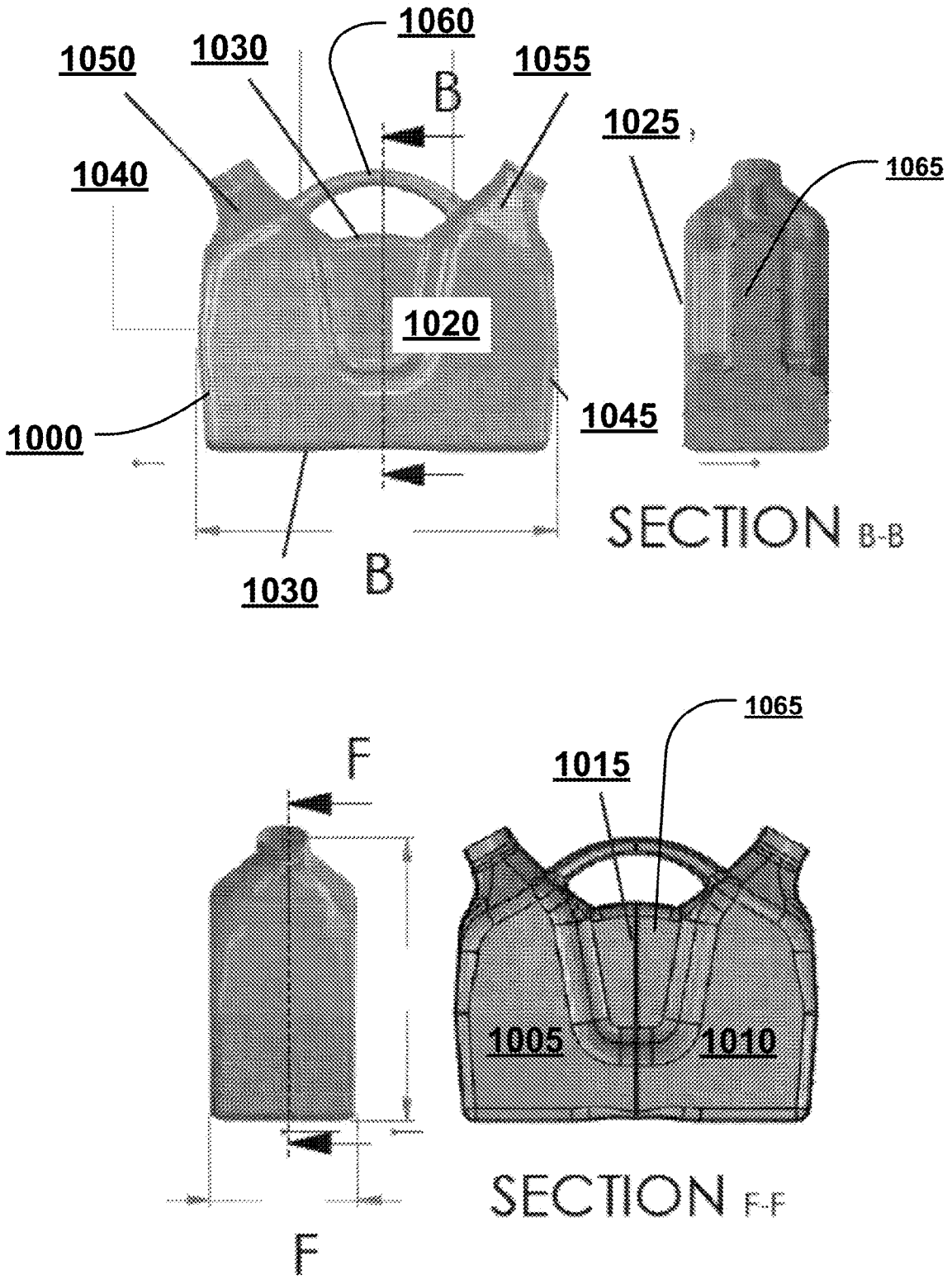
FIG. 10 shows a multi-compartment container according to some embodiments of the present invention.

FIG. 10 shows views of a multi-compartment container 1000 according to some embodiments of the invention. The multi-compartment container 1000 may be used for any of the purposes described herein. For example, the multi-compartment container 1000 may be used for holding fluids, including perishable fluids, such as milk, juice, cooking oil, combinations thereof, and the like. In one example, one compartment of the multi-compartment container 1000 may hold one material, such as regular milk, while another compartment of the multi-compartment container 1000 may hold another material, such as chocolate milk. However, dry goods, such as breakfast cereal, flour, sugar, etc. may be stored in the multi-compartment container 1000. The multi-compartment container 1000 may be made of any of the materials discussed herein, combinations thereof, and the like. For example, the multi-compartment container 1000 may be constructed from a polymer, paper, fiber, and/or metal material by such techniques as molding, casting, stamping, bonding, welding, 3D printing, combinations thereof, and/or the like. In some embodiments, the multi-compartment container 1000 may be made of a liquid proof material.

The multi-compartment container 1000 may include a first compartment 1005 separated from a second compartment 1010. In some embodiments, the first compartment 1005 may be fluidly separated from the second compartment 1010 (i.e., the divider 1015 is impermeable to liquid). The first compartment 1005 may be separated from the second compartment 1010 by a divider 1015. The divider 1015 may be internal to the multi-compartment container 1000 in some embodiments. In some embodiments, the divider 1015 may be partially external to the multi-compartment container 1000, e.g., creating a rib on the outside of the multi-compartment container 1000, such that the divider 1015 is evident upon external inspection of the multi-compartment container 1000. For example, such embodiments may make it clear to consumers that the multi-compartment container 1000 indeed includes more than one separate compartment. Although shown and described as being vertically oriented, it is contemplated that the divider 1015 may be in any orientation, e.g., horizontal, vertical, at an angle, etc., and in any suitable shape. The divider 1015 may be made of the same or a different material than the remainder of the multi-compartment container 1000. In some embodiments, the multi-compartment container 1000 may be contoured inward, i.e., have a smaller depth along at least a portion of the multi-compartment container 1000 between the first compartment 1005 and the second compartment 1010, as shown in section B-B, which is a front or back-facing cross-section of the multi-compartment container 1000 about axis B. This area 1065 of lesser depth of the multi-compartment container 1000 may or may not form a part of the first compartment 1005 and the second compartment 1010. As shown in section F-F, which is a lateral cross-section of the multi-compartment container 1000 about axis F, this area 1065 of lesser depth may form a part of the first compartment 1005 on one side of the divider 1015, and form a part of the second compartment 1010 on the other side of the divider 1015. In some embodiments, this area 1065 of lesser depth may be solid, i.e., not hollow, such that it cannot hold a product therein.

In some embodiments, the compartments 1005, 1010, may each hold half of a typical consumer volume container. For example, each compartment 1005, 1010 may hold a half gallon of contents, for a total of one gallon of contents in the multi-compartment container 1000. In another example, each compartment 1005, 1010 may hold a liter of soda, for a total of two liters of soda in the multi-compartment container 1000. However, each compartment 1005, 1010 may hold any volume of contents, including different volumes of contents in each compartment. In other words, although each volume is shown to be approximately equal in FIG. 10, it is contemplated that the volumes of each compartment 1005, 1010 may be different. In addition, although shown as having two compartments, separated by one divider 1015, it is contemplated that the multi-compartment container 1000 may include any number of compartments separated by any number of dividers.

The multi-compartment container 1000 may include several external surfaces. In some embodiments, the external surfaces may be continuously and/or seamlessly joined. The external surfaces may include a front surface 1020 opposite a rear surface 1025, a bottom surface 1030 opposite a top surface 1035, and lateral surfaces 1040, 1045 opposite to one another. In some embodiments, the front surface 1020 and the rear surface 1025 may have non-uniform or non-planar surface structures in order to reduce internal volume of the multi-compartment container 1000. The divider 1015 may be at least partially internal to these external surfaces, as described above.

A first spout 1050 may be connected to the first compartment 1005, e.g., fluidly connected. The first spout 1050 may include a first closure, such as a twist off cap or seal, that is single use or reusable. In some embodiments, the first spout 1050 may include more than one closure, such as a single use closure covered by a reusable closure. In some embodiments, the first closure may fluidly seal the first compartment 1005.

A second spout 1055 may be connected to the second compartment 1010, e.g., fluidly connected. The second spout 1055 may include a second closure, such as a cap or seal, that is single use or reusable. In some embodiments, the second spout 1055 may include more than one closure, such as a single use closure covered by a reusable closure. In some embodiments, the second closure may fluidly seal the second compartment 1010.

In some embodiments, a handle 1060 may connect the first spout 1050 to the second spout 1055, while being elevated above the top surface 1035 such that a gap is present between the handle 1060 and the top surface 1035. In some embodiments, the handle 1060 may be formed from depressions in the front surface 1020 and the rear surface 1025 without creating a gap. The handle 1060 may be hollow and include an extension of the divider 1015 so as to prevent mixing of the contents of the first compartment 1005 and the second compartment 1010. In some embodiments, the handle may be internally solid so as to prevent mixing of the contents of the first compartment 1005 and the second compartment 1010.

The above description is illustrative and is not restrictive. Many variations of the invention will become apparent to those skilled in the art upon review of the disclosure.

One or more features from any embodiment may be combined with one or more features of any other embodiment without departing from the scope of the invention. For example, any of the above-described multi-compartment containers can be combined with any other suitable embodiment or type of multi-compartment container in any suitable manner in methods or systems according to embodiments of the invention. As an illustration, a multi-compartment container can have a first box type compartment and second bag type compartment. Alternatively, one compartment can have plastic or composite walls to contain wet products while the attached second compartment can have cardboard walls to contain dry products.

A recitation of "a", "an" or "the" is intended to mean "one or more" unless specifically indicated to the contrary.

What is claimed is:

1. A multi-compartment storage device comprising:

a top surface;

a bottom surface positioned opposite to the top surface;

a front surface connecting the top surface to the bottom surface;

a rear surface connecting the top surface to the bottom surface and positioned opposite to the front surface;

a first lateral surface extending from the bottom surface to the top surface and connecting the front surface to the back surface;

a second lateral surface positioned opposite to the first lateral surface and extending from the bottom surface to the top surface, wherein the second lateral surface connects the front surface to the back surface;

a first spout extending from the first lateral surface, the top surface, the front surface, and the rear surface;

a second spout extending from the second lateral surface, the top surface, the front surface, and the rear surface;

a divider extending from the bottom surface to the top surface and connecting the front surface to the rear surface, wherein the divider divides the multi-compartment storage device into a first compartment and a second compartment;

an area of lesser depth extending from the top surface along a portion of the divider, the area of lesser depth comprising an area within which a distance between the front surface and the rear surface is less than the distance between the front surface and the rear surface surrounding the area of lesser depth, the portion of the divider being greater than half of the divider and less than the whole divider.

2. The multi-compartment storage device of claim 1, further comprising:

a handle positioned between the first spout and the second spout.

3. The multi-compartment storage device of claim 2, wherein an opening is formed between the handle and the top surface.

4. The multi-compartment storage device of claim 1, wherein the first compartment is coupled to the first spout, and wherein the second compartment is coupled to the second spout.

5. The multi-compartment storage device of claim 1, wherein the divider is configured to fluidly separate the first compartment from the second compartment.

6. The multi-compartment storage device of claim 1, wherein the divider protrudes from at least one of the top surface, the bottom surface, the front surface, or the rear surface.

7. The multi-compartment storage device of claim 1, wherein the first compartment has a first volume, wherein the second compartment has a second volume, and wherein the first volume and the second volume are equal.

8. The multi-compartment storage device of claim 1, wherein the divider is positioned perpendicular to the bottom surface.

9. The multi-compartment storage device of claim 1, wherein the top surface, the bottom surface, the front surface, the rear surface, the first lateral surface, and the second lateral surface form a unitary body.

10. The multi-compartment storage device of claim 1, wherein the top surface, the bottom surface, the front surface, the rear surface, the first lateral surface, and the second lateral surface, and the divider form a unitary body.

11. The multi-compartment storage device of claim 1, wherein the top surface, the bottom surface, the front surface, the rear surface, the first lateral surface, and the second lateral surface, the first spout, the second spout, and the divider form a unitary body.

12. The multi-compartment storage device of claim 1, wherein the top surface, the bottom surface, the front surface, the rear surface, the first lateral surface, and the second lateral surface, the first spout, the second spout, and the divider are made of a same material.

13. The multi-compartment storage device of claim 1, wherein the material is a liquid-proof material.

14. The multi-compartment storage device of claim 1, wherein the first compartment stores a first portion of a product, and wherein the second compartment stores a second portion of the product.

15. The multi-compartment storage device of claim 1, wherein the first compartment stores a first portion of a first product, wherein the second compartment stores a second portion of a second product, and wherein the first product and the second product are different.

16. The multi-compartment storage device of claim 1, further comprising:

a first closure element coupled to the first spout; and a second closure element coupled to the second spout.

17. The multi-compartment storage device of claim 16, wherein at least one of the first closure element and the second closure element is reusable.

18. The multi-compartment storage device of claim 16, wherein the first closure element includes a first single use closure element covered by a first reusable closure element, and wherein the second closure element includes a second single use closure element covered by a second reusable closure element.

19. The multi-compartment storage device of claim 1, wherein the area of lesser depth comprises a first portion of the first compartment and a second portion of the second compartmen.

* * * * *